US009498051B1

(12) United States Patent
White

(10) Patent No.: US 9,498,051 B1
(45) Date of Patent: Nov. 22, 2016

(54) GINGIVAL STIMULATOR AND METHOD OF USE

(71) Applicant: Dennis J. White, Plainsboro, NJ (US)

(72) Inventor: Dennis J. White, Plainsboro, NJ (US)

( * ) Notice: Subject to any disclaimer, the term of this patent is extended or adjusted under 35 U.S.C. 154(b) by 297 days.

(21) Appl. No.: 14/226,563

(22) Filed: Mar. 26, 2014

Related U.S. Application Data

(60) Provisional application No. 61/853,006, filed on Mar. 26, 2013.

(51) Int. Cl.
*A46B 9/02* (2006.01)
*A46B 9/04* (2006.01)
*B08B 7/00* (2006.01)

(52) U.S. Cl.
CPC . *A46B 9/04* (2013.01); *A46B 9/02* (2013.01); *A46B 9/025* (2013.01); *B08B 7/00* (2013.01)

(58) Field of Classification Search
CPC ..... A46B 9/025; A46B 9/02; A46B 9/021; A46B 9/04; A61C 15/00
USPC ..... 15/167.1
See application file for complete search history.

(56) References Cited

U.S. PATENT DOCUMENTS

| | | | | |
|---|---|---|---|---|
| 301,644 | A * | 7/1884 | Thmpson | A46B 9/005 15/110 |
| 4,520,526 | A * | 6/1985 | Peters | A46B 5/0062 15/143.1 |
| 5,459,899 | A * | 10/1995 | Bauer | A46B 9/04 15/110 |
| 7,360,270 | B2 * | 4/2008 | Moskovich | A46B 5/0029 15/167.1 |
| 2001/0005917 | A1 * | 7/2001 | Harada | A46B 9/026 15/167.1 |
| 2013/0185881 | A1 * | 7/2013 | Suzuki | A46B 9/04 15/167.1 |

* cited by examiner

*Primary Examiner* — Saeed T Chaudhry
(74) *Attorney, Agent, or Firm* — Dorothy S. Morse

(57) ABSTRACT

A gingival stimulator having optionally-angled bundled bristles anchored in at least one row in a brush head, and a narrow working footprint of collective bristle free tip ends having a maximum width dimension of approximately four millimeters. If splayed and/or flared, bristles have a preferred maximum free tip end density of approximately twelve bristles-per-square-millimeter. When moved into contact with teeth, the free tip ends easily navigate around them, promptly advancing to interproximal areas. The brush head is agitated with one or two hands and a quick vibratory motion when the free tip ends are in perpendicular contact with interdental papilla. Thus, gingival tissue becomes stimulated by the bristle free tip ends, dislodging food particles and bringing increased blood flow to it, keeping the gingival tissue in good health while avoiding the placement of adverse damaging forces against adjacent tooth structure during gingival stimulation, and preserving teeth from abrasion and notching.

20 Claims, 4 Drawing Sheets

GINGIVAL STIMULATOR AND METHOD OF USE

CROSS-REFERENCES TO RELATED APPLICATIONS

This patent application relates in subject matter to U.S. provisional patent application 61/853,006 filed by the same inventor on Mar. 26, 2013, which has overlapping subject matter therewith and the title of Gingival Stimulator and Method of Use. Thus, the applicant/inventor herein respectfully requests that domestic priority be granted for his currently pending U.S. utility patent application herein based upon the common subject matter found in his earlier filed U.S. provisional patent application 61/853,006 described above.

BACKGROUND

1. Field of the Invention

This invention is in the field of dental devices used for the care and cleaning of teeth and gums, particularly to a gingival stimulator having a bristle arrangement forming at least one row of bundled bristles that are anchored in a base (also referred to herein by the term "head"). When the bundled bristles anchored in the head form one row, it is preferably a thin row centered longitudinally on the base/head with bristle free tip ends forming a narrow working footprint having a preferred maximum width dimension of approximately four millimeters. The single row of bristles in the present invention gingival stimulator may also comprise a low density of bristle free tip ends as a part of its narrow working footprint, having a maximum free tip end density of approximately twelve bristles-per-square-millimeter (instead of the twenty-four bristles-per-square-millimeter commonly found in today's toothbrushes), significantly lessening tooth abrasion when gingival tissue is cleaned. Optionally, the bundled bristles in the single row may also have a columnar configuration, splayed free tip ends, and/or flared free tip ends as long as collectively the flaring does not exceed a width dimension of approximately four millimeters. However, when bristle free tip ends are flared and/or splayed, bristle density may drop to only two to six bristles-per-square-millimeter.

In contrast, when the bundled bristles of the present invention form two or more rows, the bristles in each bundle may also have a columnar configuration, splayed free tip ends equally spaced throughout the working area of the base/head, and/or collective flaring of free tip ends with a maximum width dimension of approximately four millimeters. However, in addition, the bundled bristles may be centrally angled toward a bundle in an opposing row (hereinafter "non-staggered relation"), or have alternating relation with the bundles in the other row or rows (hereinafter "staggered relation"). As a result of differing combinations of the above-identified options, present invention gingival stimulators with multiple rows of bundled bristles are given a working footprint of collective bristle free tip ends that is purposefully narrow, allowing movement independent from bristles in adjacent bundles that minimizes tooth abrasion, and also preventing the free tip ends of the bristles in each bundle from having to overcome columnar strength so that less force is applied against teeth, resulting in less abrasion of the rounded outward tooth surfaces at or near the gingival level during the cleaning of interproximal areas of teeth.

Since it is considered within the scope of the present invention to have one or more rows of bundled bristles, solely for convenience, clarity of description, and language efficiency in the disclosure herein, embodiments with two rows of bundled bristles may more commonly be discussed hereinbelow, but such occurrence is without any intent of limitation. Whether a single row or multiple rows of bundled bristles are used in the present invention, it is contemplated for the free tip ends of the bristles to have substantially equal spacing throughout the working area of the base/head, and also provide a confluence of all (or nearly all) bristle free tip ends into a narrow working footprint having a maximum width dimension of approximately four millimeters (and typically as low as approximately two millimeters). When a single row of bundled bristles is used in a present application gingival stimulator, the anchored portion of the bristles are each substantially perpendicular to the base/head. However, if two or more rows of bundled bristles are anchored in the base/head, the rows are often directed inwardly toward one another at an angle of common intersection, which assists in creating the narrow maximum width dimension (approximately four millimeters) of the working footprint of bristle free end tips in a present invention gingival stimulator. In addition, while a longitudinal orientation of the free tip ends across the base/head is generally preferred (as seen in the accompanying illustrations), although a horizontal orientation of the low-density working footprint of bristle free tip ends is not shown, it is also considered to be equivalent structure and within the scope of the present invention.

Optionally, the bristles in the present invention gingival stimulator may be fewer in number overall than those found in prior art toothbrushes (perhaps as few as 300 bristles per head, but not limited thereto), and bristle length in present invention gingival stimulators does not need to be fixed to a single dimension. Quite the contrary, since people's mouths and teeth vary in size, the length dimension of the bristles in each present invention gingival stimulator will be determined according to the distance needed to reach interproximal areas for effective gingival tissue stimulation. Consequently, present invention gingival stimulators may be manufactured and sold in more than one size, with the larger sizes having a greater number of bristles and/or bristles having a greater diameter and/or length dimension. For proper gingival cleaning while also preserving teeth from abrasion and notching, when the bristles are flared or splayed, the preferred bristle free tip end density in each bundle of preferred embodiments of the present invention is approximately one-half to approximately one-fourth (and perhaps even a bit less) that observed in today's toothbrushes (which typically have about twenty-four bristles-per-square-millimeter), a dramatic departure from the 100-year old system and method of making dental brushes that continues today.

During its use in a horizontally extending orientation, and particularly as the bristles of the present invention gingival stimulator are initially advanced toward teeth, bristles are held substantially perpendicular to the long axis of tooth structure and the tooth-gingival margin so that the arrangement of bristles effectively accommodates the tooth structure for cleaning interproximal tooth structure and cleaning/massaging soft tissue in tooth-gingival margins. When present, splayed bristles further assist in this accommodation of tooth structure. Either the free tip ends of the bristles freely go around teeth and into the interproximal areas with less force applied to the surface of adjacent teeth than would otherwise occur with the bristles of a present day toothbrush, or the present invention bristles remain in safe contact with teeth and do not cause any significant abrasion or notching thereto. Once the free tip ends of the present invention bristles become situated in the interproximal areas and are ready for gingival stimulation, the bristles are held in perpendicular contact with the interproximal gingival tissue, and the handle depending from one end of its base/head is agitated with a quick vibratory action. One of the user's hands may hold the bristles in place, while the other hand agitates the bristles. During agitation, with the free tip ends of the present invention bristles in perpendicular contact with the interproximal tooth surfaces and gingival tissue, the remaining present invention bristles are sufficiently bent over the most prominent outward facing areas of the adjacent teeth to prevent damaging forces from being applied to them. Thus, in this new method for gingival tissue stimulation to help reduce gum recession, nearly all of the free tip ends of the bristles in the present invention gingival stimulator find their way into the targeted interproximal areas between teeth, resulting in the outward facing surface structure of the adjacent teeth being substantially protected from damaging forces that could otherwise occur if a present day toothbrush was used instead, while gingival tissue in the interproximal areas are appropriately stimulated to dislodge food particles there from and otherwise keep the tissue around the teeth in good health.

2. Description of the Related Art

Today's toothbrushes comprise a collection of many bundles of bristles. On average, each bundle consists of about 60-75 bristles, although some may have as few as 35-40. The diameter dimension of bristles in today's toothbrushes may also vary from approximately 0.006-inches to 0.008-inches, however, the bristle density in today's toothbrushes generally remains about twenty-four bristles-per-square-millimeter. The bundles in today's toothbrushes are also typically columnar, separated from each other in the brush base/head holder, and aligned in horizontally and vertically extending (non-staggered) rows, with the columnar bundle structure causing the bristles therein to have approximately the same density at its base as occurs in its free tip ends. These toothbrushes generally serve well for cleaning the easily reached outward facing surfaces of teeth. However, the free tip ends of the bristles of present day toothbrushes are also somewhat bundled, substantially replicating the anchored base end bristle arrangement and creating a columnar configuration. Since toothbrush bristles tend to hit the closest thing to them during cleaning use, the part of the tooth facing most outward from the mouth is cleaned first, before the working/distal tips of the bristles are pressed further into the interproximal areas between teeth that are more important to keep clean. Thus, as the bristles are pressed further into the interproximal areas, the compressed bundling of the working/free ends of the bristles serves detrimentally to the most outward parts of the adjacent teeth. The bundled bristles will act as a column, with added force being needed to overcome the strength of the column before splaying of the bristle ends can occur, which is required to allow at least some bristle tips to be directed around the teeth and into the deeper interproximal areas. Thus, the columnar configuration of bristles provides an inefficient design for gingival tissue stimulation at the density of today's toothbrushes, which consequently causes destructive abrasion to the outward facing part of the tooth structure over time.

In addition, teeth have a rounded configuration at the gingival level, with this curved part of the teeth bearing the force of columnar bundles of toothbrush bristles as attempts are made with them to reach gingival tissue in interproximal areas, with the teeth eventually becoming worn from tooth brushing near the gum line, a condition known as notching. With regard to the aging process of human teeth, if people live long enough they will eventually experience recession of the gum and notching of teeth at the gum line. The notches are not decay, but treated as such and filled with a composite resin restoration. Notching is a common occurrence in elderly patients that is treated by dentists on a daily basis. If untreated, notches progress, and can eventually advance down to a tooth's nerve. Gum recession also remains a serious concern for all dental patients, and there is always room for new products that can be effectively used for the cleaning of tooth-gingival margins and gum tissue stimulation. The present invention provides gum tissue stimulation and overcomes the detrimental forces caused by a columnar configuration to preserve teeth from abrasion and notching by having their tips aligned in a narrow working footprint having a maximum width dimension of approximately four millimeters, and also optionally using a lower density of bristle free tip ends (a maximum of approximately twelve bristles-per-square-millimeter). Furthermore, a density of about six to twelve bristles-per-square-millimeter is preferred in columnar bristle arrangements, dropping even lower to about two to six bristles-per-square-millimeter when flaring and/or splaying occurs, approximately one-half to one-fourth of the approximately twenty-four bristles-per-square-millimeter density in today's toothbrushes that still survives from a system and method of making dental brushes that dates back about one hundred years.

In contrast to the known prior art, the present invention discloses a gingival stimulator having a bristle arrangement anchored into a base/head depending from one end of an elongated handle and forming at least one row (preferably longitudinally-extending) of independently anchored groups of bundled bristles. When multiple rows of bristles are present, they may be directed inwardly toward one another at an angle of common intersection, as long as the maximum width dimension of the working footprint of free tip ends remains approximately four millimeters. In addition and in contrast to present day toothbrushes, the array of bristles in present invention gingival stimulators includes bundles of bristles that are each independently anchored on their base ends, but instead of the bundles having a columnar configuration, the free tip ends of their bristles are equally spaced apart in a single working footprint, and may be splayed or flared (again, as long as the maximum width dimension of the working footprint of free tip ends remains approximately four millimeters. Also, the number of bristles in present invention gingival stimulators may be fewer than that found in a conventional toothbrush, and the density of bristle free tip ends may range between about six to about twelve bristles-per-square-millimeter, and perhaps even less when the free tip ends of bristles are flared and/or splayed. With the combination of structural features provided by the present invention, the free tip ends of most present invention bristles are able to freely go around a tooth into the interproximal areas with less force than would be required during the use of a conventional toothbrush, while the remaining bristles and portions thereof remain in safe contact with adjacent teeth.

To provide gingival stimulation, the present invention bristles reaching the interproximal area are held in perpendicular contact with gingival tissue while the handle depending from the base/head is agitated. One hand may be in contact with the rear portion of the base/head and pressing against it to hold the bristles in place against interproximal tooth surfaces and/or gingival tissue, while the other hand agitates the bristles with a quick vibratory motion using the handle depending from the base/head. In the alternative, bristle agitation may be accomplished one-handed. In the most prominent areas of the tooth (the most outward facing part thereof), present invention bristles are sufficiently bent over it so that less damaging force is applied. As a result in this new method of gingival cleaning/massaging/stimulation, the free tip ends of nearly all stimulator bristles will find their way to the targeted interproximal areas. Therefore, tooth structure is preserved from damaging bristle forces, while interproximal areas of gingival tissue are appropriately stimulated to dislodge food particles and maintain the tissue in good health. When the bristle tip ends are splayed, the present invention has the advantage of having groups of bristles each anchored so that their free tip ends can be flared out into a narrow and low-density working footprint that requires less resistance against tooth structure and is able to penetrate deeply between the teeth and reach gingival tissue for massaging/stimulation purposes. By easily going around the teeth, the bristles create less wear on the adjacent gum line and root structure, maximizing oral health. Also, should the free tip ends of the flared bristles contact a very broad tooth surface, such as an outward facing tooth surface, the bristles then buckle back with little damaging force applied to the tooth, as there is no added force needed to overcome columnar strength (as in conventional toothbrushes). The end result is a stimulated gum, with lesser trauma to adjacent hard dental structure. In patient testing of the present invention, a lingering "tingling" sensation was generally experienced during the hour following gingival stimulation. Some bleeding also occurred, even in healthy mouths. However, after about two months from the start of gingival tissue stimulation with the present invention, substantially all bleeding and pain subsided, and patient gums improved, leading to a high level of patient acceptance. No prior art dental brush intended for the general cleaning of tooth surfaces and tooth-gingival margins is known to provide independently anchored bundled bristles in a narrow arrangement having its bristles' free tip ends terminating in a working footprint having a maximum width dimension of approximately four millimeters, as found in the present invention, which has been observed by the inventor herein during its development to reduce wear on the rounded outward facing tooth surfaces adjacent to tooth-gingival margins while also reducing gum recession, maximizing oral health.

BRIEF SUMMARY OF THE INVENTION

The primary objective of the present invention is to provide a gingival stimulator that applies less force against teeth, and provides less abrasion of the rounded outward facing tooth surfaces at or near the gingival level during the cleaning of interproximal areas between teeth to reduce wear and deterioration of tooth surfaces, as well as gum recession. A further objective of this invention is to provide a gingival stimulator wherein each bundle is freestanding and the free tip ends of the bristles in each bundle have independent movement. It is also an objective of this invention when more than one row of bundled bristles is present for each bundle to be independently anchored into the front surface of the stimulator base/head with all free tip ends of bristles terminating in a narrow working footprint preferably having a maximum width of approximately four millimeters. It is a further objective of this invention for the free tip ends of its bristles to have substantially equal spacing throughout the working area of the base/head. It is yet another objective of this invention to provide a gingival stimulator having multiple bundles of bristles arranged in at least one row with the free tip ends of the bristles in each bundle having a maximum density of approximately twelve bristles-per-square-millimeter. It is also an objective of this invention to provide a gingival stimulator and method of use through which the gingival stimulator may be used with two hands for cleaning the interproximal areas of teeth, wherein one hand holds the free tip ends of bristles in contact with adjacent teeth surfaces, while the other hand causes an agitation of the bristles with a quick vibratory motion. It is yet another objective of this invention to provide a gingival stimulator with sturdy and durable construction for repeat use. It is a further objective of this invention to provide a gingival stimulator with a handle having thickness and length dimensions that allow easy and comfortable manipulation by a user's hand.

The most preferred embodiment of the present invention gingival stimulator discloses at least one row of anchored bristles having free tip ends that form a narrow working footprint with a maximum width dimension of approximately four millimeters. The bristle density may also be less than in conventional toothbrushes, and as a result bristle free tip ends will move independently from adjacent bristles, thus, particularly when flared and splayed bristles are present, no columnar bundling of bristle free tip ends occurs (a problem common to conventional toothbrushes that may cause excessive tooth abrasion). The free tip ends of the present invention gingival stimulator are equally spaced throughout a preferably longitudinally-extending working area on the front of the brush head, and during use substantially all of the free tip ends are advanced directly to the interproximal areas without abrasive damage to adjacent teeth, since the broad tooth structure thereon presents minimal resistance to movement of the bristle free tip ends in a narrow working footprint across it. As a present invention gingival stimulator is advanced toward a tooth, the arrangement of its bristles in a narrow working footprint also facilitates accommodation of the tooth structure, with either the free tip ends of bristles freely going around the tooth into the interproximal areas with less force than would occur using a present day toothbrush, or, they safely contact the tooth. As the bristles' free tip ends are held in contact to the interproximal gingival tissue, the handle and base are agitated. In the most prominent areas of the tooth (the most outward facing part thereof), the bristles are sufficiently bent over, so that less damaging force is applied. In this new technique of gingival stimulation disclosed herein, most bristle free tip ends will find their way to the target interproximal areas. Also, although not critical, it is intended for the present invention gingival stimulator to be held in a generally horizontal orientation relative to teeth so that cleaning of multiple interproximal areas can occur during each agitation step. However, when the bristles are advanced straight toward tooth-gingival margins, they have a perpendicular orientation to the long axis of the tooth structure. Therefore, during use of present invention gingival stimulators the tooth structure is substantially preserved from the damaging force of the bristles that would otherwise be applied while tooth-gingival margins in interproximal areas are stimulated with dental brushes in common use today. During two-handed use, the user may hold the bristles in place with one hand, while the other hand (preferably the predominant hand) agitates the bristles with a quick vibratory motion.

DETAILED DESCRIPTION OF THE INVENTION

Figure 1:
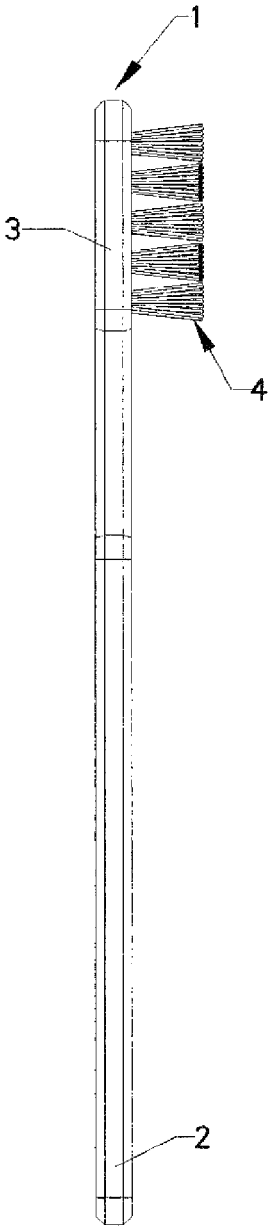
FIG. 1 is a left side view of a first preferred embodiment of the present invention gingival stimulator having bundles of splayed bristles anchored in two rows longitudinally in the front of the stimulator head, with the base ends of the bundles in each row anchored in alternating relation to the base ends of the bundles of bristles in the opposing row so that when viewed from the side each bundle is completely visible, and further with the bristles in each row inwardly directed at an angle of common intersection that causes the free tip ends of the bristles in both rows terminate in one narrow and low-density working footprint having a maximum width dimension of approximately four millimeters, the bristles in each bundle also freestanding and having movement independent of the bristles in the next adjacent bundle or bundles, with the free tip ends of the bristles in FIG. 1 also shown having substantially equal spacing across the working area of the base/head.

The present invention gingival stimulator 1 has been created to reduce gum recession and notching of teeth during the important cleaning of interproximal areas of teeth that is preferred at least minimally on a daily basis for good oral health. Attached to the elongated handle 2 of its most preferred embodiments is a head 3 having bundles of bristles 4 positioned in at least one longitudinally-extending row, although a row or rows laterally-extending across head 3 is also considered to be within the scope of the present invention. If multiple rows are used, the freestanding bundles of bristles 4 in each row are positioned so that substantially all free tip ends 6 of the bristles 4 terminate in a narrow working footprint 9 having a maximum width dimension of approximately four millimeters, and further so that the free tip ends 6 of bristles 4 become substantially equally spaced throughout the working area of head 3 during present invention use. This allows each bristle 4 to have movement independent of the bristles 4 in the next adjacent bundle or bundles, enabling a different angle of attack for the bristles 4 in one bundle relative to the movement of bristles 4 in adjacent bundles, resulting in less force being applied to tooth surfaces and less tooth abrasion. Spayed and/or flared bristles 4 may be used to reduce bristle free tip end density, for further tooth abrasion-reducing advantage. Common toothbrushes today that are used by many for cleaning broad tooth surfaces, as well as interproximal tooth areas, have a bristle density of approximately twenty-four bristles-per-square-millimeter, with its columnar bristle configuration also making bristle density the same on its anchored and non-anchored ends (also herein referred to as "free tip ends 6"). In contrast, present invention bristle 4 free tip ends 6 (generally seen in FIGS. 2 and 5 aligned and closely positioned with broken line 5) which are shown to be splayed, have a maximum density of approximately twelve bristles-per-square-millimeter, and when bristles 4 are splayed and flared a bristle free tip end density may be as low as approximately two bristles-per-square-millimeter. At higher bristle densities, and further when bundles of bristles are positioned directly opposite to those in an opposing row or rows in a linear arrangement, the columnar configuration used causes convergence of all bristles from the opposing rows at a single point, making them behave as a unit and creating more wear on tooth surfaces when the cleaning of difficult-to-reach interproximal tooth areas and gingival tissue is attempted. Configurations and design considerations used in the present invention gingival stimulators promote good gum health while avoiding the excessive tooth wear and notching caused by toothbrushes in common use today. FIGS. 1-5 show various views of the head 3, handle 2, and preferred positioning of the bundles of bristles 4 in a first preferred embodiment of the present invention gingival stimulator 1 wherein bundles of bristles 4 are centrally angled and staggered relative to bundles in the opposing row, with bristles 4 splayed and flared. In contrast, FIGS. 6-10 show a similar set of illustrations for a larger number of visibly smaller bundles of columnar and non-splayed bristles 4 anchored in two non-staggered rows longitudinally on the front of the brush head 3 and substantially all of the bristle 4 free tip ends 6 terminating within a narrow working footprint 9.

Figure 2:
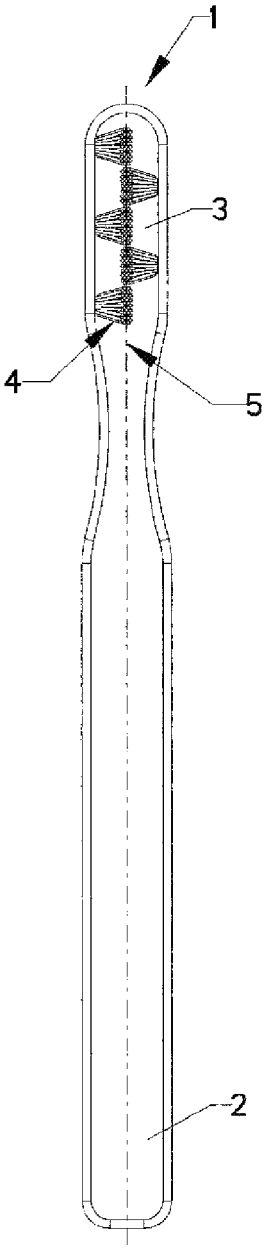
FIG. 2 is a front view of the gingival stimulator in FIG. 1 showing the bundles of bristles anchored in two spaced-apart rows longitudinally on the front of the brush head with all bristle tip ends splayed and terminating in a narrow working footprint having a low density of bristle tip ends and a maximum width dimension of approximately four millimeters, and the anchored ends of the bundled bristles in each row anchored in alternating relation to those of the bundled bristles in the opposing row, allowing each bristle to have independent movement uninhibited by bristles in the next adjacent bundle or bundles.
Figure 3:
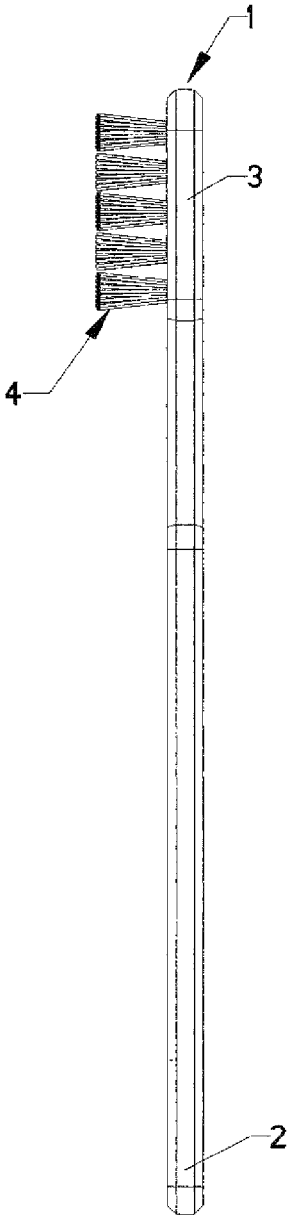
FIG. 3 is a right side view of the gingival stimulator in FIGS. 1 and 2 showing the back surface of the brush head and handle unadorned, and bundles of splayed bristles anchored in two rows longitudinally in the front of the stimulator head, with the base ends of the bundles in each row anchored in alternating relation to the base ends of the bundles of bristles in the opposing row so that when viewed from the side each bundle is completely visible, and further with the bristles in each row inwardly directed at an angle of common intersection that causes the free tip ends of the bristles in both rows terminate in a narrow working footprint having a low density of bristle free tip ends and a maximum width dimension of approximately four millimeters.

FIGS. 1-5 show various views of the head 3, handle 2, and preferred positioning of the bundles of bristles 4 in a first preferred embodiment of the present invention gingival stimulator 1. FIGS. 1-3 are respectively a left side view, a front view, and a right side view of gingival stimulator 1 having bundles of bristles 4 arranged in two rows longitudinally in the front of the brush head 3, with the base of the bundles of bristles 4 in each row anchored in alternating relation to the bundles of bristles 4 in the opposing row so that when viewed from the side most of the bristles 4 in each bundle are visible. Due in large part to the longitudinal splaying of bristles 4, they evenly extend substantially across brush head 3. Also, when the density of bristles 4 is much less than in prior art toothbrushes (not shown), and particularly when bristles 4 are also splayed, flared, and/or part of a bundle having staggered relation with the bundles of bristles 4 in opposing rows, bristles 4 act independently and effectively move around teeth into interproximal areas between teeth without causing tooth abrasion. The bristles 4 in each row of the first preferred embodiment of present invention gingival stimulator 1 are also directed inwardly toward the other row and positioned at an angle of common intersection, such that substantially all of the free tip ends 6 of the bristles 4 terminate in a narrow working footprint 9, preferably having a maximum width dimension of approximately four millimeters that allows the bristles 4 in each bundle to remain freestanding and each bristle 4 to have movement independent of the bristles 4 in the next adjacent bundle or bundles. Although the thickness and length dimensions of the head 3 and handle 2 shown in FIGS. 1-3 are preferred, they should not be considered as limiting. Furthermore, the length and width dimensions of the bristles 4 shown in FIGS. 1-3 are merely exemplary, and should also not be considered as limiting. The number of bundles of bristles 4 may also be different from that shown in FIGS. 1-3, as the present invention may be provided in an assortment of sizes for different sizes of mouth cavities in people of differing stature. Furthermore, bristles 4 are preferably made from soft materials as an additional precaution against tooth surface erosion and notching.

FIG. 2 shows the bundles of bristles 4 anchored in two spaced-apart rows longitudinally extending on the front of the brush head 3 with the free tip ends 6 of all bristles 4 terminating in a narrow and centrally-positioned working footprint 9. Although centrally-positioned of working footprint 9 is preferred, it is not critical. FIG. 2 also shows the anchored ends of the bundled bristles 4 in each row anchored in alternating (staggered) relation to those of the bundled bristles 4 in the opposing row, which in combination with the splayed configuration of bristles 4 allows each to have movement uninhibited by the bristles 4 in the next adjacent bundle or bundles. Splaying may also lower the density of bristle 4 free tip ends 6, which further reduces tooth abrasion. FIGS. 1-3 show gingival stimulator 1 having the back and side surfaces of its brush head 3 unadorned, as well as back, side, and front surfaces of its handle 2. However, such lack of ornamentation is not critical to the present invention, and although not shown, surface printing and/or other adornment or color diversity, including textured surface patterns and transparent or translucent material with visible imbedded decorative elements, is considered to be within the scope of the present invention. FIG. 3 also shows bundles of splayed bristles 4 anchored in two rows longitudinally in the front of brush head 3, with the base ends of the bundles of bristles 4 in each row anchored in alternating relation to the base ends of the bundles of bristles 4 in the opposing row so that when viewed from the side each bundle of bristles 4 is completely visible, and further with the bristles 4 in each row inwardly directed at an angle of common intersection that causes the free tip ends 6 of the bristles 4 in both rows to terminate in a narrow working footprint 9 (refer to FIG. 5). When the bundles of bristles 4 are in two or more rows and inwardly directed toward a point of common intersection, some bristles 4 may be longer than others so that the free tip ends 6 of all bristles 4 terminate in a narrow working footprint 9 having a maximum width dimension of approximately four millimeters. Furthermore, the length, width, and thickness dimensions of brush head 3 and handle 2 in FIGS. 1-3 are merely exemplary, and may be different from that shown in other preferred embodiments of the present invention. Also, the proportional dimensions of brush head 3 relative to handle 2 may be different from that disclosed in FIGS. 1-3.

Figure 4:
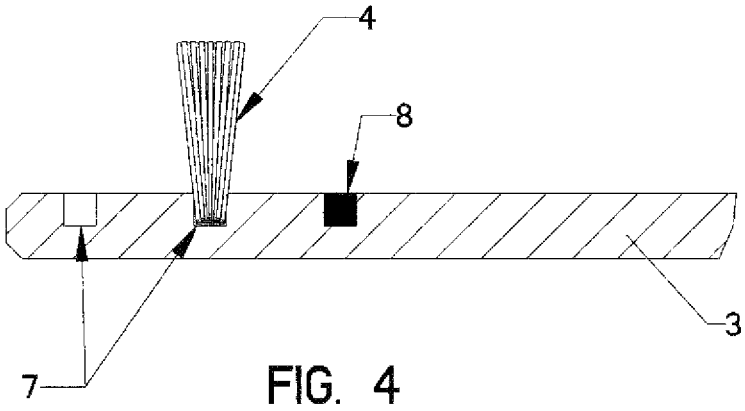
FIG. 4 is a sectioned view of the head of the gingival stimulator in FIGS. 1-3 showing the anchoring of one bundle of splayed bristles therein and one receiving bore created in the head for the anchoring of one additional bundle of bristles that together will provide one row of splayed bristles, the darkened space within the rightmost bore representing adhesive, overmolding, or other substance or material that helps the anchored ends of the bundled bristles to stay in a fixed position relative to the head during tooth cleaning use and gingival stimulation.
Figure 5:
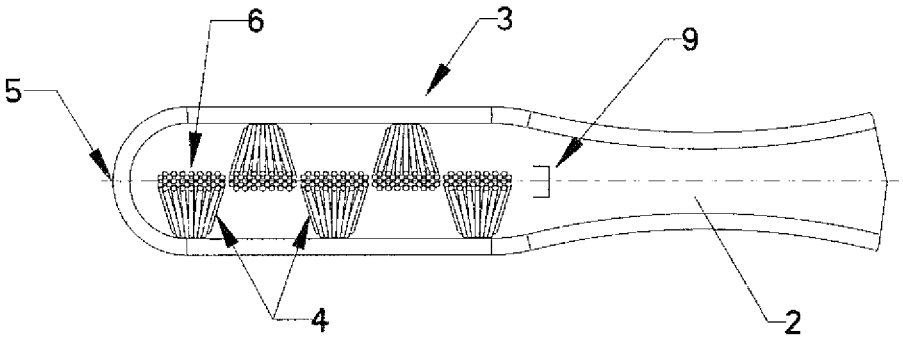
FIG. 5 is an enlarged front view of the head of the gingival stimulator in FIGS. 1-4 showing bundles of bristles arranged in two rows longitudinally therein, the base ends of the bundles in each row anchored in alternating relation to the bundles of bristles in the opposing row and the bristles in all bundles having an angled orientation allowing the free tip ends of all bristles in both rows to terminate in a narrow working footprint having a low density of bristle free tip ends and a maximum width dimension of approximately four millimeters, a broken line generally identifying the orientation of the narrow working footprint and a bracket marking its width dimension, with the bristles in each bundle freestanding and having movement independent of the bristles in the next adjacent bundle or bundles to provide less abrasion of the rounded outward tooth surfaces at or near the gingival level during the cleaning of interproximal areas of teeth and gums.

FIG. 4 is a sectioned view of the head 3 of the gingival stimulator 1 in FIGS. 1-3 showing the anchoring of one bundle of bristles 4 therein and one empty receiving bore 7 created in head 3 for the anchoring of one additional bundle of bristles 4 that together will provide one row of splayed bristles 4 (in addition to any bundles of bristles 4 added to the remaining receiving bore 7 visible in FIG. 4, if needed). It is contemplated for the darkened space within the rightmost receiving bore 7 to represent adhesive 8, overmolding, or other substance or material or pressure-fitting that helps the anchored ends of the bundle of bristles 4 to stay in a fixed position relative to head 3 during tooth cleaning use. In contrast, FIG. 5 is an enlarged front view of the brush head 3 of the gingival stimulator 1 in FIGS. 1-4 showing bundles of bristles 4 arranged in two rows longitudinally therein, the base of the bundled bristles 4 in each row anchored in alternating (staggered) relation to the bundles of bristles 4 in the opposing row and the bristles 4 in all bundles having an angled orientation allowing the tip ends of all bristles 4 in both rows to terminate in a narrow working footprint 9, with a bracket positioned between head 3 and handle 2 generally identifying the width dimension of working footprint 9 of the collective bristle 4 free tip ends 6. The maximum contemplated density of splayed bristle 4 free tip ends 6 is approximately twelve bristles-per-square-millimeter in the present invention, much less than in today's commonly used toothbrushes (not shown, but typically having a bristle density of about twenty-four bristles-per-square-millimeter), and it further contemplated for the density of bristle 4 free tip ends 6 to be as low as approximately two bristles-per-square-millimeter to approximately six bristles-per-square-millimeter in the present invention when bristles 4 are splayed and flared while their respective bundles are also positioned in staggered rows. The longitudinal splaying of the bristles 4 shown in FIG. 5 allows the bristles 4 in each bundle to be freestanding and have movement independent from the bristles 4 in the next adjacent bundle of bristles 4 to provide less abrasion of the rounded outward tooth surfaces at or near the gingival level during the cleaning of interproximal areas of teeth. Although the narrow working footprint 9 formed by the free tip ends 6 of bristles 4 is typically centered longitudinally on head 3 (marked by the broken line 5), this is not critical. Furthermore, as previously mentioned in this disclosure, a row or rows bristles 4 laterally-extending across head 3 is also considered to be within the scope of the present invention. The narrow working footprint 9 of bristles 4 is more clearly visible in FIG. 5 than in the previously presented illustration in FIG. 2.

FIG. 6-10 shows a similar set of illustrations to that shown in FIGS. 1-5. However, the main differences noted in FIGS. 6-10 are that its bundles of bristles 4 are smaller than in FIGS. 1-5 and have less bristles-per-bundle, and furthermore the bundles of bristles 4 are columnar and its non-splayed bristles 4 are anchored in two non-staggered rows longitudinally on the front of the brush head 3 and substantially all of the bristle 4 free tip ends 6 terminate within a narrow working footprint 9 (which although it appears larger than in FIGS. 2 and 5, working footprint 9 would still have a maximum width dimension of approximately four millimeters). Another difference noted between FIGS. 2/5 and FIGS. 7/10 are that the anchored ends of the angled bristles 4 in FIGS. 2/5 are closer to the side edge of head 3 than the anchored ends of the bristles 4 in FIGS. 7/10.

Figure 6:
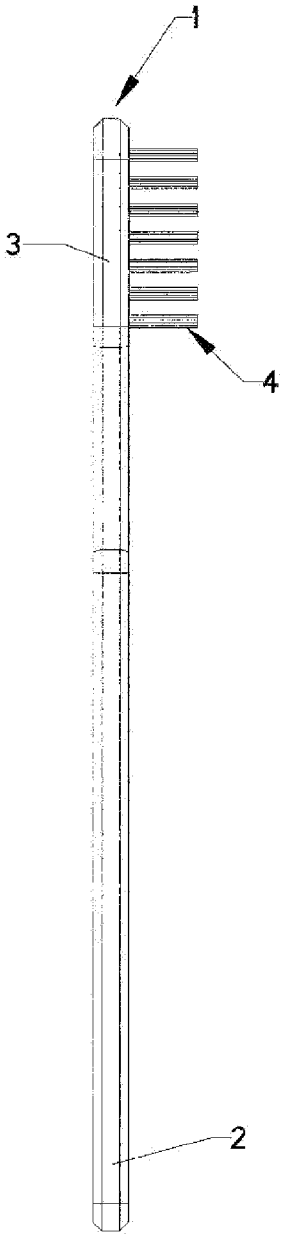
FIG. 6 is a left side view of a second preferred embodiment of the present invention gingival stimulator having bundles of non-splayed bristles anchored in two rows longitudinally in the front of the stimulator head, with the base ends of the bundles in each row anchored in non-staggered relation to the base ends of the bundles of bristles in the opposing row so that when viewed from the side the bundles in the remote row are hidden by the bundles in the near row, and further with the bristles in each row freestanding and having movement independent of the bristles in the next adjacent bundle or bundles, the bundles are also small and anchored to cause the arrangement of bristle free tip ends in a narrow working footprint preferably having a maximum width dimension of approximately four millimeters, the bristles in each bundle also freestanding and having movement independent of the bristles in the next adjacent bundle or bundles, with the free tip ends of the bristles in FIG. 6 also shown having substantially equal spacing across the working area of the base/head.
Figure 7:
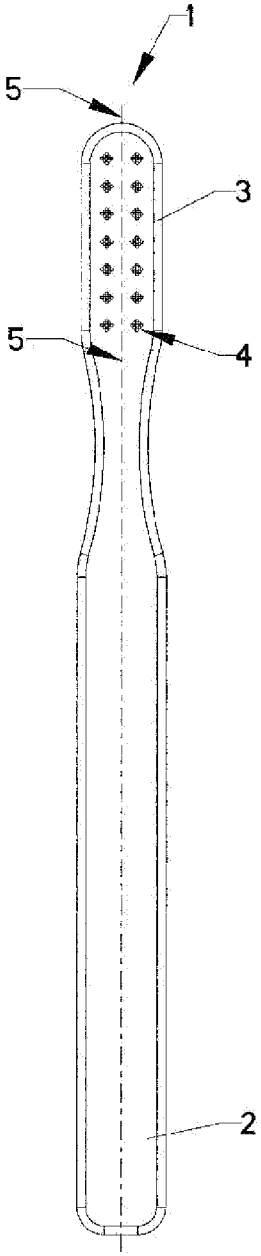
FIG. 7 is a front view of the gingival stimulator in FIG. 1 showing the bundles of bristles anchored in two spaced-apart rows longitudinally on the front of the brush head with all bristle free tip ends non-splayed and terminating in a narrow working footprint preferably having a maximum width dimension of approximately four millimeters, and the anchored ends of the bundled bristles in each row anchored in non-staggered relation to those of the bundled bristles in the opposing row, the bristles in each bundle also freestanding and having movement independent of the bristles in the next adjacent bundle or bundles, with the free tip ends of the bristles in FIG. 7 also shown having substantially equal spacing across the working area of the base/head while confined to the narrow working footprint.
Figure 8:
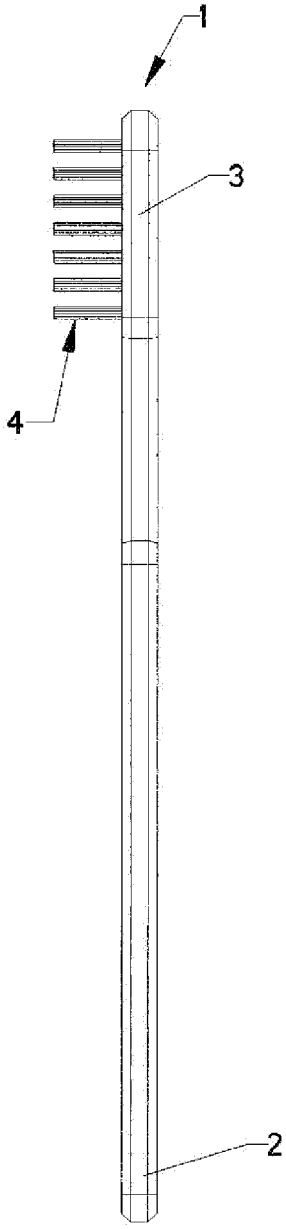
FIG. 8 is a right side view of the gingival stimulator in FIGS. 6 and 7 showing the back surface of the brush head and handle unadorned, and bundles of non-splayed bristles anchored in two rows longitudinally in the front of the stimulator head, with the base ends of the bundles in each row anchored in non-staggered relation to the base ends of the bundles of bristles in the opposing row so that when viewed from the side each bundle in the remote row remains hidden by the bundles in the near row, the bristles in each row freestanding and having movement independent of the bristles in the next adjacent bundle or bundles, the bundles are also small and anchored to cause the arrangement of bristle free tip ends in a narrow working footprint preferably having a maximum width dimension of approximately four millimeters, with the free tip ends of the bristles in FIG. 8 also shown having substantially equal spacing across the working area of the base/head.

FIGS. 6, 7, and 8 are respectively a left side, a front view, and a right side view of second preferred embodiment of gingival stimulator 1 having bundles of splayed bristles 4 anchored in two rows longitudinally in the front of head 3, with the base ends of the bundles in each row anchored in non-alternating (non-staggered) relation to the base ends of the bundles of bristles 4 in the opposing row so that when viewed from the side the bundles of bristles 4 in the row remote from a viewer are completely hidden behind the near row of bristled 4. Furthermore, the free tip ends 6 of the bristles 4 in both rows terminate in a narrow working footprint 9 having a maximum width dimension of approximately four millimeters, allowing the bristles 4 in each bundle to remain freestanding and each bristle 4 to have movement independent of the bristles 4 in the next adjacent bundle or bundles. FIG. 7 shows the bundles of bristles 4 anchored in two spaced-apart rows longitudinally on the front of the brush head 3 with all bristle 4 free tip ends 6 non-splayed and terminating in a narrow working footprint 9, and the base ends of the bundled bristles 4 in each row anchored in non-alternating (non-staggered) relation to those of the bundled bristles 4 in the opposing row, allowing each bristle 4 to have movement uninhibited by bristles 4 in the next adjacent bundle or bundles. FIG. 8 shows gingival stimulator 1 having the back and side surfaces of its brush head 3 unadorned, as well as back, side, and front surfaces of its handle 2 also unadorned. However, such lack of ornamentation is not considered critical to the present invention. FIG. 8 also has bundles of non-splayed bristles 4 anchored in two rows longitudinally in the front of head 3, with the base ends of the bundles of bristles 4 in each row anchored in alternating relation to the base ends of the bundles of bristles 4 in the opposing row so that when viewed from the side, each bundle in the row remote from a viewer is completely hidden behind the near row of bristles 4. In addition, FIG. 8 shows the bundles of bristles 4 substantially evenly spaced longitudinally across brush head 3. Furthermore, the length, width, and thickness dimensions of brush head 3 and handle 2 in FIGS. 6-8 are merely exemplary, and may be different from that shown in other preferred embodiments of the present invention. Also, the proportional dimensions of brush head 3 relative to handle 2 may be different from that disclosed in FIGS. 6-8.

Figure 9:
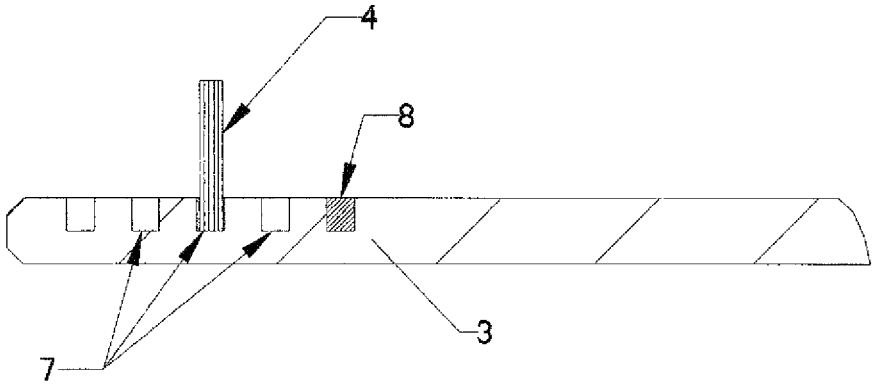
FIG. 9 is a sectioned view of the head of the gingival stimulator in FIGS. 6-8 showing the anchoring of one bundle of non-splayed bristles therein and one receiving bore created in the head for the anchoring of one additional bundle of bristles that together will provide one row of non-splayed bristles, the darkened space within the rightmost bore representing adhesive, overmolding, or other substance or material that helps the anchored ends of the bundled bristles to stay in a fixed position relative to the head during tooth cleaning use and gingival stimulation.
Figure 10:
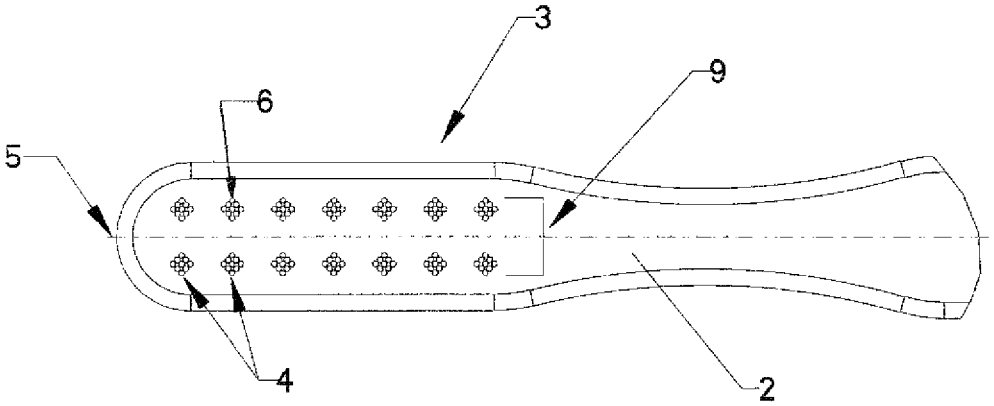
FIG. 10 is an enlarged front view of the head of the gingival stimulator in FIGS. 6-9 showing bundles of bristles arranged in two rows longitudinally therein, the base ends of the bundles in each row anchored in non-staggered relation to the bundles of bristles in the opposing row and the free tip ends of all bristles in both rows terminating in a narrow working footprint defined by a bracket having a maximum width dimension of approximately four millimeters, a broken line generally identifying the orientation of the narrow working footprint, with the bristles in each bundle freestanding and having movement independent of the bristles in the next adjacent bundle or bundles to provide less abrasion of the rounded outward tooth surfaces at or near the gingival level during the cleaning of interproximal areas of teeth and gums.

FIG. 9 is a sectioned view of the head 3 of the gingival stimulator 1 in FIGS. 6-8 showing the anchoring of one bundle of non-splayed bristles 4 therein and one empty receiving bore 7 created in the head 3 for the anchoring of one additional bundle of bristles 4 that together with the displayed bundle of bristles 4 will provide one row of non-splayed bristles. The darkened space within the rightmost receiving bore 7 represents adhesive, overmolding, or other substance or material or material or pressure-fitting that helps the anchored ends of the bundled bristles 4 to stay in a fixed position relative to the head 3 during tooth cleaning use and gingival stimulation. FIG. 10 is an enlarged front view of the head 3 of the gingival stimulator 1 in FIGS. 6-9 showing bundles of bristles 4 arranged in two rows longitudinally therein, the base ends of the bundles of bristles 4 in each row anchored in non-alternating (non-staggered) relation to the bundles of bristles 4 in the opposing row and the free tip ends 6 of all bristles 4 in both rows terminating in a narrow working footprint 9 having a bracket positioned between head 3 and handle 2 generally identifying its width dimension (which is contemplated to be a maximum of approximately four millimeters) that allows the bristles 4 in each bundle to be freestanding and have movement independent of the bristles 4 in the next adjacent bundle or bundles, providing less abrasion of the rounded outward tooth surfaces at or near the gingival level during the cleaning of interproximal areas of teeth and gums. As mentioned before, when the free tip ends 6 of bristles 4 are splayed or flared (not shown in FIGS. 6-10), the flaring and splaying may provide a bristle 4 density as low as approximately two bristles-per-square-millimeter to six bristles-per-square-millimeter, however, for the columnar arrangement of bristles 4 shown in FIGS. 6-10, the density of the free tip ends 6 of bristles 4 to be the same as that displayed by their anchored/base ends (which may be lower than that of prior art toothbrushes, or not).

The preferred embodiments of the present invention gingival stimulator 1 (or other) can be used in the traditional way to clean the easily reached outward-facing and rearward-facing surfaces of teeth, generally brushing in a downward direction across exposed tooth surfaces. However, during the cleaning of interproximal tooth and gum areas between adjacent teeth, the narrow working footprint 9 formed by the free tip ends 6 of bristles 4 can also be aligned horizontally with a targeted interproximal area and agitated with a one-handed or two-handed action. During a one-handed agitation, after alignment of working footprint 9 with the targeted interproximal area, the user may enwrap a portion of one hand around handle 2 and then cause a quick vibratory motion of gingival stimulator 1 while placing one or two fingers of the vibrating hand against the back of brush head 3 to maintain the free tip ends 6 of bristles 4 in full contact with the teeth while agitation occurs. During two-handed use, a finger or fingers on one of the user's hands may be used to secure the back of head 3 so as to hold the free tip ends 6 of bristles 4 against the targeted interproximal area, while the other hand (preferably the user's predominant hand) engages handle 2 and with a quick vibratory motion causes agitation of the free tip ends 6 of bristles 4 again the interproximal area to clean tooth surfaces therein.

While the written description of the invention herein is intended to enable one of ordinary skill to make and use its best mode, it should also be appreciated that the invention disclosure only provides examples of specific embodiments and methods, and many variations, combinations, and equivalents also exist which are not specifically mentioned. The present invention should therefore not be considered as limited to the above-described embodiments, methods, and examples, but instead encompassing all embodiments and methods within the scope and spirit of the invention, as disclosed in the attached set of claims.

I claim:

1. A gingival stimulator used for cleaning interproximal areas between teeth, including gingival tissue while applying less abrasion against the exposed outward facing tooth surfaces, said gingival stimulator comprising:

an elongated handle with opposed ends;

a brush head depending from one of said opposed ends of said handle and having front and back surfaces, said front surface having a plurality of receiving holes aligned in at least one row; and a plurality of bristles arranged to form a number of bundles of said bristles equal to the number of said receiving holes, each said bristle having a free tip end and an anchored end, with said anchored ends of said bristles in each said bundle secured within a different one of said receiving holes that causes said bundle to become freestanding, and said free tip ends of said bristles in each said bundle are splayed during manufacture and also collectively aligned with said free tip ends of said splayed bristles in the remaining ones of said bundles, allowing said free tip ends of said splayed bristles to evenly extend across at least a portion of said brush head in a narrow working footprint having a maximum width dimension of approximately four millimeters, and further allowing said bristles in each said bundle to have movement independent from and substantially uninhibited by movement of said bristles in adjacent ones of said bundles, wherein said bristles apply less force against teeth and provide less abrasion of the rounded outward facing tooth surfaces at or near the gingival level during the cleaning of interproximal areas of teeth and gingival tissue.

2. The gingival stimulator of claim 1 wherein said free tip ends in said narrow working footprint are low-density, with each said bundle having approximately two to six bristles-per-square-millimeter.

3. The gingival stimulator of claim 1 having one row of said bristles, and said anchored ends of bristles are substantially perpendicular to said front surface of said brush head.

4. The gingival stimulator of claim 1 wherein said bristles are made from soft materials.

5. The gingival stimulator of claim 1 wherein said working footprint is longitudinally extending on said brush head.

6. The gingival stimulator of claim 5 wherein said working footprint is centered on said brush head.

7. The gingival stimulator of claim 1 having at least two rows of said receiving holes aligned in staggered array, wherein said free tip ends in said working footprint collectively have a maximum density of approximately four bristles-per-square-millimeter, and said bundled bristles are centrally angled toward said narrow working footprint.

8. The gingival stimulator of claim 1 having at least two rows of said receiving holes aligned in non-staggered array, wherein said free tip ends in said working footprint collectively have a maximum density of approximately four bristles-per-square-millimeter, and said bundled bristles are centrally angled toward said narrow working footprint.

9. The gingival stimulator of claim 1 wherein said bundled bristles are centrally angled toward said narrow working footprint.

10. The gingival stimulator of claim 1 wherein said free tip ends in said working footprint collectively have a maximum density of approximately four bristles-per-square-millimeter.

11. The gingival stimulator of claim 1 wherein said head comprising two of said rows of bundled bristles and said receiving holes in one said row are positioned in staggered relation to the receiving holes in the other one of said rows, aligning none of said receiving holes in one said row directly with any of said receiving holes in the remaining one of said rows.

12. The gingival stimulator of claim 11 wherein said bundles of bristles in said two rows are also inwardly directed and angled, causing said free tip ends of said bristles to become part of said working footprint.

13. The gingival stimulator of claim 1 wherein said head comprising two of said rows of bundled bristles and said receiving holes in one said row are positioned in non-staggered relation to the receiving holes in the other one of said rows.

14. A method for using said gingival stimulator of claim 1 to clean interproximal areas between adjacent teeth, said method comprising the steps of:

horizontally aligning said working footprint formed by said free tip ends of said bristles with a targeted interproximal area in need of cleaning;

applying sufficient pressure against said back portion of said head to hold said free tip ends of said bristles in contact with said tooth surfaces in said targeted interproximal area; and using said handle to cause a quick vibratory motion of said bristles against said targeted interproximal area to clean tooth surfaces therein.

15. The method of claim 14 wherein said steps of applying pressure and using said handle to cause a quick vibratory motion of said bristles are accomplished one-handed.

16. The method of claim 14 wherein said steps of applying pressure and using said handle to cause a quick vibratory motion of said bristles are accomplished two-handed.

17. The method of claim 14 wherein said at least one targeted interproximal area spans across more than two adjacent teeth.

18. The method of claim 14 further comprising a step of inwardly directing said bristles toward said tooth structures in a perpendicular orientation that moves said bristles straight against said tooth-gingival margins within said at least one targeted interproximal area and said step occurring before said step of applying pressure, and also comprising an additional step of maintaining said perpendicular orientation of said bristles relative to said tooth-gingival margins during said quick vibratory motion with said additional step occurring concurrently with said step of using said handle to cause a quick vibratory motion.

19. The method of claim 18 wherein said steps of applying pressure, using said handle to cause a quick vibratory motion, and maintaining said perpendicular orientation are accomplished one-handed.

20. The method of claim 18 wherein said steps of applying pressure, using said handle to cause a quick vibratory motion, and maintaining said perpendicular orientation are accomplished two-handed.

* * * * *